US007823432B2

(12) United States Patent
Ooka et al.

(10) Patent No.: US 7,823,432 B2
(45) Date of Patent: Nov. 2, 2010

(54) METHOD OF FORMING SPRING WASHER BLIND-HOLES INTO A PISTON FOR AN AUTOMOBILE TRANSMISSION

(75) Inventors: Masakazu Ooka, Naka (JP); Yoshiki Hiyama, Naka (JP); Kentaro Tanabe, Naka (JP); Yoshiyuki Kanzaki, Fukushima (JP); Satoshi Sato, Fukushima (JP); Yoshihisa Yamazaki, Fukushima (JP); Kiichiro Goto, Fukushima (JP)

(73) Assignees: Ibaraki Steel Center Co., Ltd., Ibaraki (JP); NOK Corporation, Tokyo (JP)

( * ) Notice: Subject to any disclaimer, the term of this patent is extended or adjusted under 35 U.S.C. 154(b) by 16 days.

(21) Appl. No.: 12/453,510

(22) Filed: May 13, 2009

(65) Prior Publication Data

US 2009/0282885 A1 Nov. 19, 2009

(30) Foreign Application Priority Data

May 16, 2008 (JP) ..... 2008-129853

(51) Int. Cl.
*B21D 22/00* (2006.01)
*B21C 23/00* (2006.01)

(52) U.S. Cl. ..... 72/356; 72/256

(58) Field of Classification Search ..... 72/335, 72/348, 356, 353.2, 355.4, 355.6, 358, 359, 72/336, 341, 352, 353.3, 256
See application file for complete search history.

(56) References Cited

U.S. PATENT DOCUMENTS 7,370,505 B2 * 5/2008 Ser et al. ..... 72/335
2004/0244459 A1 * 12/2004 Shiokawa ..... 72/356
2006/0144118 A1 * 7/2006 Nakata ..... 72/335
2007/0006628 A1 * 1/2007 Tabei et al. ..... 72/348

FOREIGN PATENT DOCUMENTS

| | | |
|---|---|---|
| JP | 62-49015 | 3/1987 |
| JP | 3-51513 | 8/1991 |
| JP | 11-047869 | 2/1999 |
| JP | 2001-107981 | 4/2001 |
| JP | 2002-361507 | 12/2002 |
| JP | 2003-001548 | 1/2003 |

* cited by examiner

*Primary Examiner*—Dana Ross
*Assistant Examiner*—Mohammad Yusuf
(74) *Attorney, Agent, or Firm*—Wenderoth, Lind & Ponack, L.L.P.

(57) ABSTRACT

The problem to be solved by the present invention is to clear up an eccentric load onto a pin and a problem of deformation and cavity due to flowing material during extrusion when spring washer blind-holes in a piston for an automobile transmission are formed by extrusion with a pin. After an annular region along the peripheral edge portion on the back of an end plate of a secondary workpiece is flattened, the secondary workpiece is set on a lower die. Further, while the lower die is pressed with upper dies and cushion pressure is applied on the lower die, pins, for piercing the spring washer blind-holes are made to perform an extrusion operation onto the end plate of the secondary workpiece from the backside of the end plate. The extruded material is made to flow into recess holes of the upper die, and thus spring washer blind-holes are formed. Then, projections which have flowed and protrude on the front side are removed by turning with a lathe.

9 Claims, 6 Drawing Sheets

METHOD OF FORMING SPRING WASHER BLIND-HOLES INTO A PISTON FOR AN AUTOMOBILE TRANSMISSION

BACKGROUND OF THE INVENTION

1. Technical Field

The present invention relates to a method of forming spring washer (seat) blind-holes of a piston for an automobile transmission, wherein a plurality of spring washer blind-holes on the back of an end plate of the piston for the automobile transmission are formed efficiently, keeping endurance of pins for piercing the spring washer blind-holes, and precisely by cold forging.

2. Background Art

At the moment, it seems that a method of forming spring washer blind-holes of a piston for an automobile transmission through forging technology has not been proposed yet.

For example, it is shown in Patent Document 1 that spring washer blind-holes (they are simply referred to as recesses in the document) are disposed on the inner surface of the end plate of the piston in a multiple-disc clutch. However, there is no comment upon the method of forming them.

With regard to the method of manufacturing oil hydraulic machine parts in Patent Document 2, a combined method of die casting and plastic working is introduced as a production process of pistons for an automobile transmission. No examples of a piston having spring washer blind-holes on its end plate are provided in the document, and naturally no description on any spring washer blind-holes is given there.

About formation of spring washer blind-holes in another industrial field, there are some proposals such as Patent Documents 3, 4, and 5. However, all of the proposed methods of forming spring washer blind-holes are entirely different than that of the present invention in material, size, etc. of the workpieces, and even in the manufacturing methods. The proposed methods do not fall under forging technology, and have nothing to do with the present invention.

As far as the applicant is concerned, it seems that spring washer blind-holes of a piston for an automobile transmission are, at present, generally formed by drilling. When spring washer blind-holes are formed by drilling, the bottom end of the holes formed will be in the shape of a steeple-crowned cap corresponding to that of the tip of a drill, that is to say, the nearer to the center of the hole the gradually deeper the bottom end surface of the hole is. Since a hole with such a shape as above cannot stably hold the end of the spring, subsequent retouch machining by an endmill will necessarily be performed to flatten the bottom end. When spring seat blind-holes are formed by drilling, the drilling operations should naturally be repeated as many times as the number of spring seat blind-holes to be formed. The operations above are very inefficient, and moreover, subsequent endmilling operations in the same number as the drilling operations are also necessary and more inefficient in cost.

Accordingly, a fixing seat has been proposed in Patent Document 6. The fixing seat is a member comprising a lower portion in the shape of a cone or a truncated cone and an upper portion formed into a flat plate. Inserting and disposing the fixing seat under the drilled holes to provide flat bottom ends to the holes, the fixture is intended to be used as an appropriate spring seat and the like. The document suggests that the holes applied to spring seat blind-holes are impossible to be formed only by drilling, and proposes a means to solve the problem without using any endmilling operation. However, the proposal has not solved such inefficiency that extra parts should be employed and that drilling operations should be repeated as many times as the number of spring seat blind-holes to be required.

Besides, in the case of the present invention, the thickness of the bottom end of the spring seat blind-holes must come thin due to the formation of spring seat blind-holes on the back of end plates of pistons for automobile transmissions. When trying to form the holes by drilling, and where the spring seat blind-holes are bored on the end plates of pistons for automobile transmissions, shear stress due to drilling will occur at the tip of a drill, and it is liable to result in occurrence of strain cavities or cracks on the bottom end because of the thin bottom end.

CITATION LIST

Patent Literature

PTL 1: JP, 2001-107981, A
PTL 2: JP, 11-47869, A
PTL 3: JP, 03-51513, B
PTL 4: JP, 2002-361507, A
PTL 5: JP, 2003-1548, A
PTL 6: JP, 62-49015, U

SUMMARY OF THE INVENTION

Technical Problem

The present invention aims to solve the problems of conventional technology mentioned above and the novel problems induced by employing forging technology through which an end plate itself of a piston for an automobile transmission is formed and spring seat blind-holes are formed efficiently into the end plate of the piston for the automobile transmission. In particular, the present invention aims to solve a problem of keeping flatness of the surface on which the spring seat blind-holes are disposed; a problem dependent on the direction of relief of flowing material during extruding operation with pins for piercing the spring seat blind-holes; a problem dependent on the flow resistance of the material; and so on. It also aims to provide a method of forming spring seat blind-holes into a piston for an automobile transmission free from those problems above.

Solution to Problem

In a first aspect of the present invention, a method of forming spring seat blind-holes into a piston for an automobile transmission through making a plurality of spring seat blind-holes on the back of an end plate of the piston body along a peripheral edge portion of the end plate, comprises the steps of; flattening an annular region on which the plurality of spring seat blind-holes will be formed, along the peripheral edge portion on the back of the end plate of the piston body; forming spring seat blind-holes predetermined in the number and in the locations into the annular region along the peripheral edge portion of the end plate, through making pins for piercing the spring seat blind-holes perform an extrusion operation onto the region from the backside of the end plate of the piston body, in which the pins are located in the same number and the same arrangement as those of the spring seat blind-holes; and making every material, which will be extruded through the extrusion operation of the pins for piercing the spring seat blind-holes, flow to project out of the front surface of the end plate.

"An end plate of the piston body" above does not only literally mean "an end plate of the piston body" but also includes an end plate in such a situation that the piston body is still on the way to completion, formation of the end plate is already completed, and some other portions of the piston body except the end plate are still formable to complete the piston body without deforming the end plate. Therefore, a piston body on the way to completion having such an end plate as described above may also be referred to as "the piston body". In the claims and the present specification, such a reference as described above is used except description of examples in the

DETAILED DESCRIPTION OF THE INVENTION

A second aspect of the present invention is the method of forming spring seat blind-holes into a piston for an automobile transmission according to the first aspect of the present invention, wherein an annular region, on which the plurality of spring seat blind-holes will be formed, along the peripheral edge portion on the back of the end plate of the piston body is flattened. This method further comprises: punching a center hole in the center of a metallic sheet material and simultaneously deep-drawing the circumference of the sheet to make circumferential sidewall rise oblique; making the circumferential sidewall upright; increasing the thickness of the peripheral edge portion on the back of the end plate through flattening part of the end plate locating inside the circumferential sidewall; and further thickening the vicinity of the peripheral edge portion on the back of the end plate and establishing perpendicularity of the surface concerned to the outer surface of the peripheral edge portion through drawing the external periphery of the circumferential sidewall.

A third aspect of the present invention is the method of forming spring seat blind-holes into a piston for an automobile transmission according to the first or second aspect of the present invention, in which the step of making the pins for piercing the spring seat blind-holes perform an extrusion operation onto the region from the backside of the end plate of the piston body is operated through guide holes bored in the lower die in the same arrangement as that of the pins for piercing the spring seat blind-holes, while pressing the upper and lower surface of the piston body with an upper die and a lower die. On the other hand, material flowing due to the forward extrusion operation with the pins for piercing the spring seat blind-holes will be induced to flow and project into recess holes located in the upper die in the same arrangement as that of the pins for piercing the spring seat blind-holes.

A fourth aspect of the present invention is the method of forming spring seat blind-holes into a piston for an automobile transmission according to the third aspect of the present invention, in which upward cushion pressure is applied to the lower die at least during the forward extrusion operation with the pins for piercing the spring seat blind-holes.

A fifth aspect of the present invention is the method of forming spring seat blind-holes into a piston for an automobile transmission according to the first, second, third, or fourth aspect of the present invention, in which the sectional area of every recess hole formed in the upper die is confined to such an extent that no cavity will be generated at the bottom end of the spring seat blind-holes formed with the pins for piercing the spring seat blind-holes in spite of the tension due to flow of the material moving away from the bottom end.

A sixth aspect of the present invention is the method of forming spring seat blind-holes into a piston for an automobile transmission according to the first, second, third, or fourth aspect of the present invention, in which the sectional area of every recess hole formed in the upper die is confined to 45-55% of the sectional area of every spring seat blind-hole formed with the pins for piercing the spring seat blind-holes.

A seventh aspect of the present invention is the method of forming spring seat blind-holes into a piston for an automobile transmission according to the first, second, third, or fourth aspect of the present invention, in which part of the section of every recess hole formed in the upper die is located in order to overlap with the circumferential sidewall rising from the end plate of a piston body, and the ratio of the sectional area of the overlapped part to that of every recess hole (the sectional area of an overlapped part/the sectional area of a recess hole×100) is confined to 10-20(%).

A eighth aspect of the present invention is the method of forming spring seat blind-holes into a piston for an automobile transmission according to the first, second, third, fourth, fifth, sixth, or seventh aspect, wherein projections which have flowed and protruded on the front side of the end plate of the piston body are removed.

ADVANTAGEOUS EFFECTS OF THE INVENTION

According to the first aspect of the present invention, the method of forming spring seat blind-holes into a piston for an automobile transmission, after forging the piston body with a flattened surface on which spring seat blind-holes are disposed, a plurality of spring seat blind-holes are formed at an extremely high speed by one stroke (i.e., simultaneously) of an extrusion operation of pins for piercing the spring seat blind-holes. Since the piercing of the spring seat blind-holes is performed, as above, after having flattened an annular region of the piston body where the spring seat blind-holes are formed, unnecessary load will not be burdened on the pins for piercing spring seat blind-holes leading to sufficiently long endurance of the pins. Besides, a plurality of spring seat blind-holes concerned can be accommodated obviously to all of the cases where they are disposed at an equal angular distance; where a part of them are partially disposed at an equal angular distance; and where all of them are disposed at random.

Further, the piercing of the spring seat blind-holes is performed by a forward extrusion operation with pins for piercing spring seat blind-holes. Therefore, since, naturally by any means using the die, flow of material is prevented out of the site for relief of material in front of the site where spring seat blind-holes are pierced, unnecessary deformation of the piston body into which spring seat blind-holes are formed will not occur.

According to the second aspect of the present invention, the method of forming spring seat blind-holes into a piston for an automobile transmission, the annular region along the back side peripheral edge of the end plate of the piston body can be flattened during forging of the piston body of a piston for an automobile transmission without requiring a particular process for the flattening. Moreover, it is convenient that the process of forging the piston body is not especially complicated, but a process which can be simply performed. Although there are many processes except the process above for flattening the region, flattening by the process mentioned above is extremely efficient because the flattening process is completed during the process of a simple forging operation on the piston body.

According to the third aspect of the present invention, the method of forming spring seat blind-holes into a piston for an automobile transmission, the forward extrusion operation with pins for piercing spring seat blind-holes is performed through guide holes in the lower die while pressing the upper and lower surface of the piston body with an upper die and a lower die and also through making material move away through recess holes bored in the upper die at the corresponding locations of the guide holes. Consequently, formation of spring seat blind-holes can be well performed by allowing excess material to flow and project into the recess holes, and by preventing unnecessary deformation of the piston body due to flow of the material into the other site.

According to the fourth aspect of the present invention, the method of forming spring seat blind-holes into a piston for an automobile transmission, when the spring seat blind-holes are formed by an upwardly forward extrusion operation with pins for piercing spring seat blind-holes while pressing the upper and lower surface of the piston body with an upper die and a lower die upward, material flowing due to the extrusion operation of pins for piercing spring seat blind-holes can be surely prevented from flowing to protrude down into the lower die by applying upward cushion pressure to the lower die in the same direction as that of the extrusion concerned.

According to the fifth aspect of the present invention, the method of forming spring seat blind-holes into a piston for an automobile transmission, through confining the sectional area of every recess hole formed in the upper die to an appropriate one, generation of a cavity at the bottom end of the spring seat blind-holes formed can be prevented by means of appropriately restraining flow of the material during forward extrusion operation with the pins for piercing the spring seat blind-holes. That is to say, a problem in that the shape of the bottom end of the spring seat blind-holes formed may become uneven can be solved. In other words, a problem in that the cavity at the bottom end will turn to an opening when a projection, for example, of the material projected opposite to the open end of the spring seat blind-holes is removed can be avoided.

According to the sixth aspect of the present invention, the method of forming spring seat blind-holes into a piston for an automobile transmission, by means of confining the sectional area of every recess hole formed in the upper die to 45-55% of the sectional area of every spring seat blind-hole formed, a problem of the cavity, which is liable to be generated during the forward extrusion operation at the bottom end of the spring seat blind-holes, can be solved. Further, it is more preferable from the viewpoint of solving cavity problem that the sectional area of every recess hole is confined to 48-52% of the sectional area of every spring seat blind-hole formed.

According to the seventh aspect of the present invention, in the method of forming spring seat blind-holes into a piston for an automobile transmission, since part of the section of every recess hole formed in the upper die is overlapped at an appropriate ratio with a circumferential sidewall rising from the end plate of a piston body, the circumferential sidewall will act as an appropriate resistance against flow of material due to a forward extrusion operation with pins for piercing the spring seat blind-holes. Consequently, a fear that a cavity may be generated at the bottom end due to tension by material moving away in front of a certain bottom end of a spring seat blind-hole can be resolved.

According to the eighth aspect of the present invention, in the method of forming spring seat blind-holes into a piston for an automobile transmission, since projections which have flowed and projected on the opposite side to the spring seat blind-holes are removed, they will not come to be any obstructions. The projections may be made to remain if they are not obstructive. Once removed, there will remain no inconvenience in any case. The projections can be very easily removed through a turning operation with a lathe and the like.

Further, in the method of forming spring seat blind-holes into a piston for an automobile transmission according to the present invention, metallic plate of the prescribed composition is forged, and spring seat blind-holes are pierced by extrusion at an overwhelmingly high speed in comparison with drilling. Generally speaking, it is very difficult to form spring seat blind-holes by plastic working in such a member as a plate with little excess material around itself because inconvenient problems like crack or deformation are liable to occur. These problems can be solved only through making maximal use of aspects 1-8 of the present invention and using every means in technology, and the spring seat blind-holes with high precision will be realized.

DETAILED DESCRIPTION OF THE INVENTION

Figure 1A:
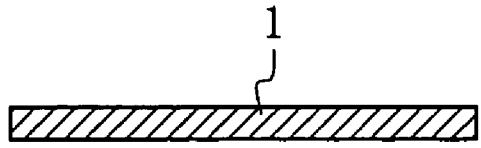
FIG. 1A, FIG. 1B, and FIG. 1C are a cross section view of a disk-like blank for making a secondary workpiece as an example, a cross section view of a primary workpiece, and a cross section view of the secondary workpiece, respectively.

A most preferable mode for carrying out the present invention will be explained referring to the drawings on the basis of the example.

In the present example, as shown in FIG. 1A, a blank 1 was formed by cutting a disc 105 mm in outer diameter out of S25C steel plate 9.0 mm thick. After being descaled by shot blasting, it was treated by so-called Bonde treating consisting of solid lubricant (phosphate). Additionally, although S25C steel plate was used to form disc-like blank 1 in the example described above, SAE1020, SAE 1018, or other equivalents can be employed in place of it as desired.

Figure 1B:
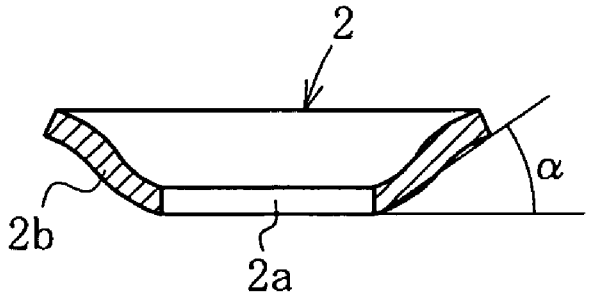
Figure 2A:
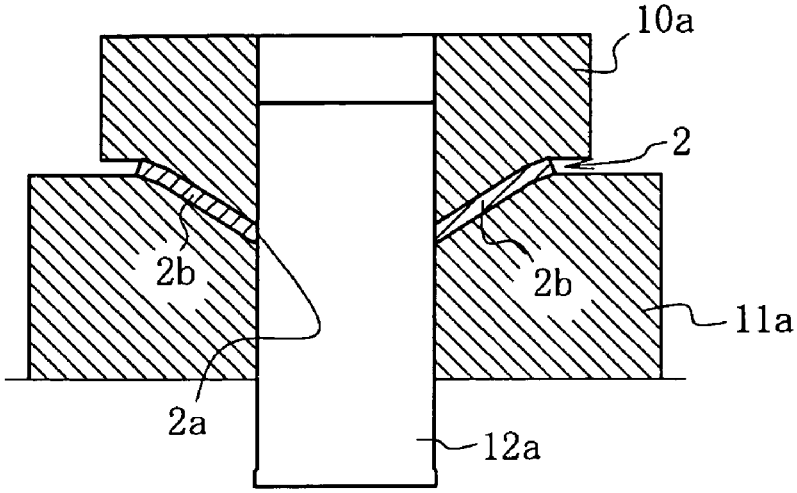
FIG. 2A and FIG. 2B are both cross section views showing an appearance of the primary and the secondary workpieces respectively being forged with a stamping press.

Then, as shown in FIG. 1B and FIG. 2A, a center-hole 2*a* was punched out in the shape of a circle in the center of the disk-like blank 1 with a punch for blanking, and simultaneously a periphery of the center-hole 2*a* was formed into a circumferential sidewall 2*b* rising obliquely (i.e., at an incline) by deep-drawing with an upper die 10*a* and a lower die 11*a* to thereby forge a primary (preliminary) workpiece 2. The reason why the deep-drawing was performed to make the circumferential sidewall 2*b* rise obliquely (at an incline) is, as described later, for ensuring the desired flow of material in the next bending and sizing operations of the forging process, and for establishing flatness in the vicinity of a backside peripheral edge portion of an end plate 3*c* of a secondary workpiece 3 forged from the blank 1.

The incline of the circumferential sidewall 2*b* of the primary workpiece 2, namely, an angle α formed by a plane and the circumferential sidewall 2*b* of the primary workpiece 2 when the primary workpiece 2 might be placed on the plane, as shown in FIG. 1B, was confined to 40 degrees. However, the angles between 30-60 degrees are effective to ensure the flatness in the vicinity of the backside peripheral edge portion of the end plate 3*c* of the secondary workpiece 3 in the forging operation.

Further, speaking just to be sure, if the blank 1 had been deep-drawn at this time so as to make its circumferential sidewall rise upright, thickening the corner with a radius of the end plate 3*c* of the secondary workpiece 3 in order to flatten the portion concerned in the vicinity of the backside peripheral edge would be impossible because of a lack of the appropriate fluidity of the material.

Figure 1C:
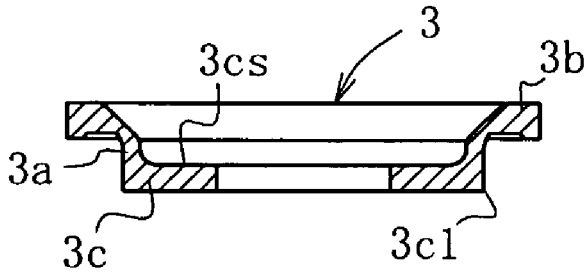
Figure 2B:
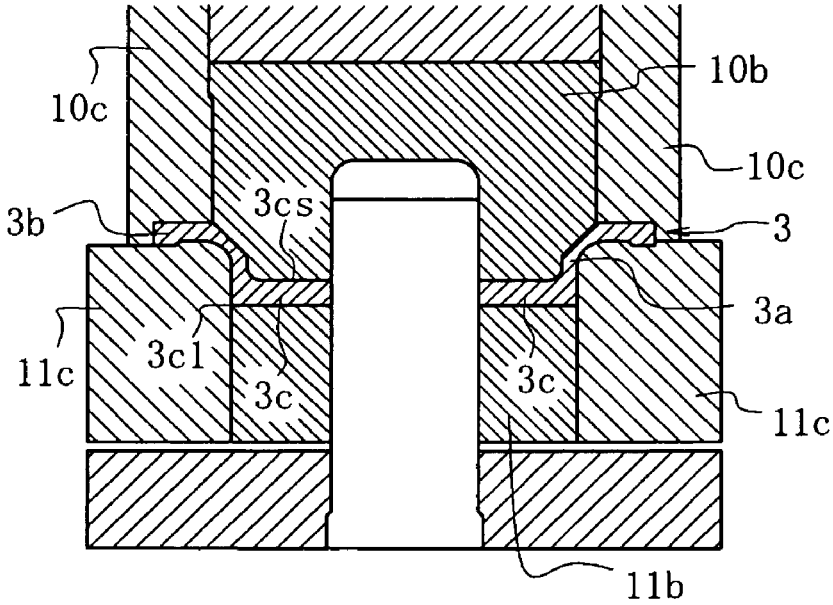

Then, as shown in FIG. 1C and FIG. 2B, the circumferential sidewall 2*b* of the primary workpiece 2 concerned was turned into a circumferential sidewall 3*a* by bending at a site between an inner peripheral edge and an outer peripheral edge of the wall to make the outer side of the sidewall rise upright. And the top end of the circumferential sidewall 3*a* was externally expanded and turned to an expansion portion 3*b* by bending perpendicularly. Another expansion portion which was internally expanded from the bottom end of the circumferential sidewall 3*a* is identified as the end plate 3*c*. Additionally, at the same time, the circumferential bottom end of the expansion portion 3*b* was made to protrude downward slightly. Further simultaneously, as shown in FIG. 2B, sizing the portions mentioned above was performed by pressing them with upper dies 10*b*, 10*c* and lower dies 11*b*, 11*c*. The workpiece thus forged is identified as the secondary workpiece 3. Since the primary workpiece 2 is formed into the shape of the secondary workpiece 3 shown in FIG. 1C by forging as mentioned above, the flatness of the secondary workpiece 3 in the vicinity of the backside peripheral edge will be ensured because of well-established flow of the material into a backside peripheral edge portion 3*c*1 of said end plate 3*c*.

Besides, the end plate 3*c* at this stage is in the same shape as that of the end plate of the piston body at a completely forged state, that is to say, at an already completed state as far as the shape of the end plate is concerned. The secondary workpiece 3 is a member whose portions except the end plate 3*c* are not at a completely formed state.

The secondary workpiece 3 made up as described above in the present example was 133 mm in outer diameter; 26 mm in height; 57 mm in inner diameter of the center hole; 105 mm in diameter of the peripheral edge of the end plate 3*c* (namely, the outer diameter at the bottom of the circumferential sidewall 3*a*); 48 mm in width of a surface on the backside of the end plate 3*c* in the shape of a doughnut.

Figure 3A:
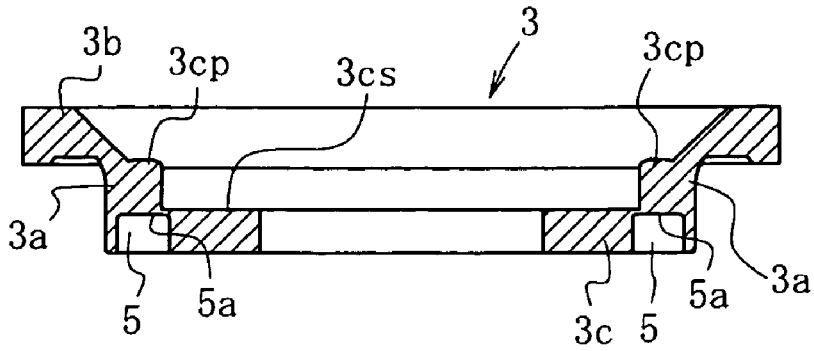
FIGS. 3A and 3B are a cross section view and a back view, respectively, of the secondary workpiece into which spring seat blind-holes are pierced.
Figure 3B:
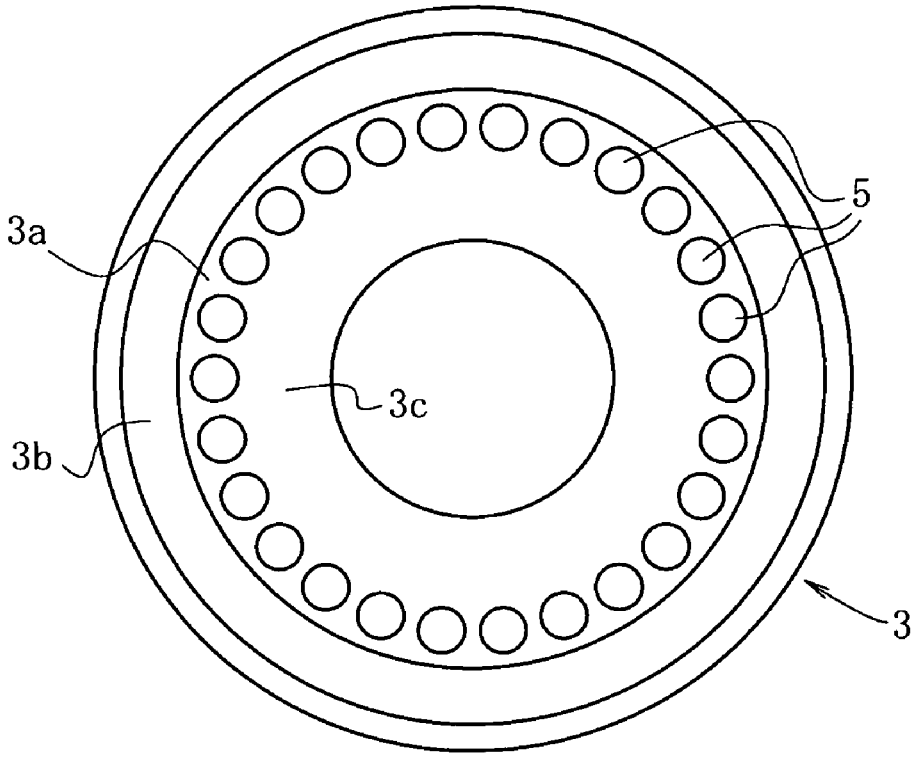

Then, in the present example, after the secondary workpiece 3 was appropriately forged, 26 spring seat blind-holes 5 were formed, as shown in FIGS. 3A and 3B, in the vicinity of the backside peripheral edge of the end plate 3*c* of the secondary workpiece 3 concerned. These spring seat blind-holes 5 were confined in the present example to 9.4 mm in hole diameter, 6.9 mm in depth, and the 26 spring seat blind-holes 5 were defined to be located annually at an equal angular distance so as to make a circle joining each spring seat blind-hole 5 respectively 91.4 mm in diameter.

Further, in the present example, the spring seat blind-holes 5 were formed at the state of the secondary workpiece 3 as above. However, the spring seat blind-holes 5 may obviously be formed after formation of the piston body has been completed.

The process of forming the spring seat blind holes 5 into the backside of the end plate 3*c* of the secondary workpiece 3 as described above was performed by so-called forging. A forging machine used for performing the process is as follows.

Figure 4:
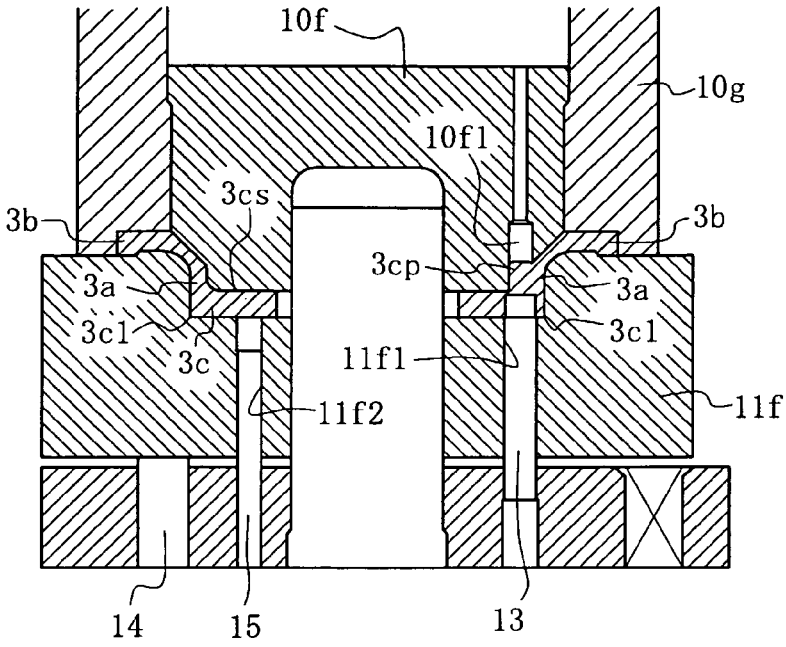
FIG. 4 is a cross section view showing an appearance of the secondary workpiece into which spring seat blind-holes are being pierced with the stamping press.

As shown in FIG. 4, the lower die 11*f* is configured to set the secondary workpiece 3 with its front side turned-up. The upper surface of the lower die 11*f* concerned is essentially in the shape corresponding to that on the backside of the secondary workpiece 3 concerned. The lower surfaces of the upper die 10*f*, 10*g* concerned are essentially in the shape corresponding to that of the front side of the secondary workpiece 3 concerned.

The lower die 11*f* comprises 26 guide holes 11*f*1 through which 26 pins 13 for piercing spring seat blind-holes pass at such a location that they correspond to the spring seat blind holes 5 to be formed on the backside of the end plate 3*c* of the secondary workpiece 3 set on the die. Also, a through-hole 11*f*2 through which a knockout pin passes is bored in the lower die 11*f*. The guide holes 11*f*1 concerned are in such an annular location at the same equal angular distance as that of the spring seat blind holes naturally when viewing from a plan view or from the bottom of the lower die 11*f*.

Further, the bottom portion of the lower die 11*f* concerned is supported by an oil hydraulic cushion machine. A cushion support 14 in FIG. 4 rises upward from the cushion machine. There are a total of four cushion supports 14 that rise upward from the top portion of the oil hydraulic cushion machine and support the lower die 11*f* in a good balance. The oil hydraulic cushion machine is used for pressing the lower die 11*f* upward during an extrusion operation with the pins 13 for piercing spring seat blind-holes in order not to make flowing material protrude to the backside of the secondary workpiece 3 by the extrusion operation of the pins 13 for piercing spring seat blind-holes.

Figure 5:
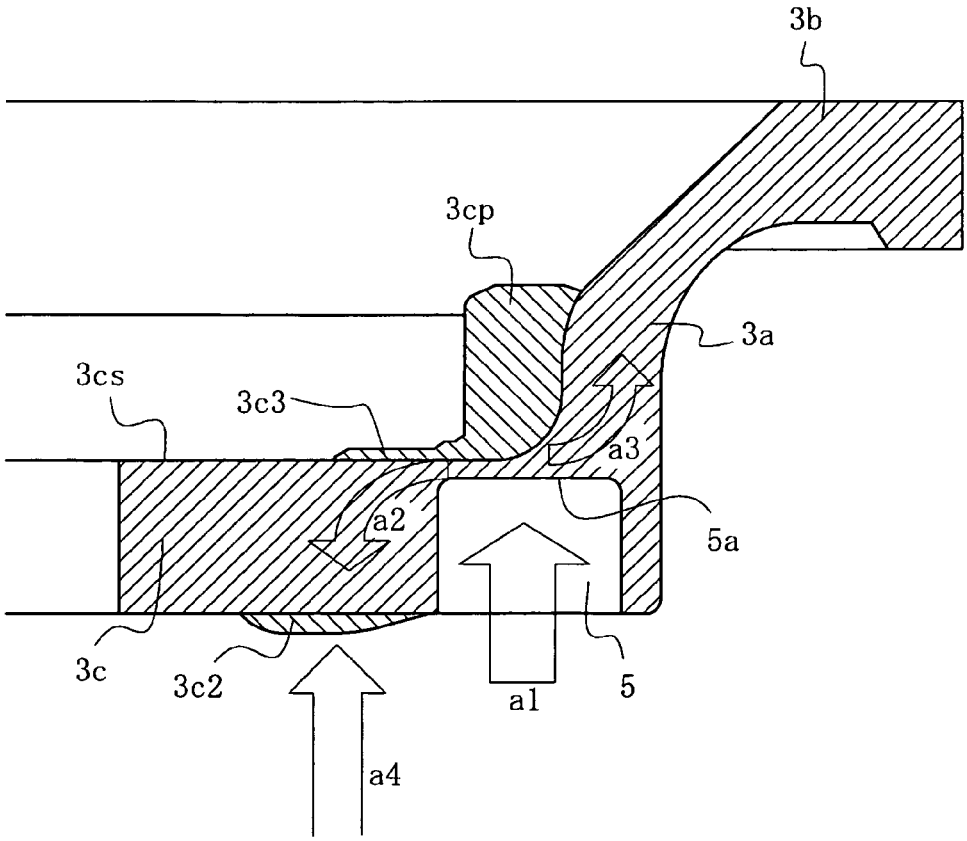
FIG. 5 is a partial sectional illustration of the secondary workpiece showing both flow of the material in the secondary workpiece and cushion pressure when pins for piercing the spring seat blind-holes perform an extrusion operation.

FIG. 5, as shown by an arrow a1, is an illustration showing a flow mode of the material when the pins 13 for piercing the spring seat blind-holes perform an extrusion operation. When the extrusion is performed as above, as long as material is suppressed on all its external surfaces with the die, the material is apt to flow in other directions which are easy to move away such as those of the end plate 3*c* and the circumferential sidewall 3*a*, respectively, as shown by arrows a2, a3 in FIG. 5. Consequently, if the suppression with the die is insufficient, protrusions will naturally be generated on the external surfaces of those sites resulting in collapse of the shape of the secondary workpiece 3. The cushion pressure applied upward to the lower die 11*f*, as described above, protects the collapse by pressing upward the secondary workpiece 3, and the lower die 11*f* presses simultaneously the side surface of the circumferential sidewall 3*a* as shown in FIG. 4. The upper dies 10*f*, 10*g* press, as described above, downward the secondary workpiece 3 and at the same time also press its circumferential sidewall 3*a* outward from the inside.

In FIG. 5, a portion 3*c*2 shows a protrusion to which the material has flowed and protruded on the backside of the end plate 3*c* of the secondary workpiece 3 in a case in which the cushion pressure to the lower die 11*f* is insufficient, and a portion 3*c*3 shows a protrusion to which the material, which ordinarily ought to flow into recess holes 10*f*1 as described later, has flowed and protruded in front of the end plate 3*c* in a similar case in which the cushion pressure to the upper die 10*f* is insufficient. In FIG. 5 again, an arrow a4 shows an appropriate cushion pressure and both protrusions 3*c*2 and 3*c*3 will not be generated when the upper dies 10*f*, 10*g* are pressed by the similar suppression pressure. That much material will flow, as described later in detail, into the recess holes 10*f*1 of the upper die 10*f*. Thus, the secondary workpiece 3 can maintain the accurate shape even after the extrusion operation with the pins 13 for piercing spring seat blind-holes.

In the central upper die 10*f* out of the upper dies 10*f*, 10*g*, recess holes 10*f*1 being the same in number are bored in such a location that they correspond, over and under, to the guide holes 11*f*1 of the lower die 11*f*. The recess holes are the openings into which material will flow due to the extruding operation of the pins 13 for piercing spring seat blind-holes. The sectional area da of the recess holes 10*f*1 was confined, in the present example, to about 49.3% of the sectional area DA of the spring seat blind-holes 5. Namely, in the present example, since the inner diameter of each of the recess holes 10*f*1 is 6.6 mm and the diameter of the spring seat blind-hole 5 is 9.4 mm, the ratio $da/DA=\pi(6.6/2)^2/\pi(9.4/2)^2$ is about 0.493 or about 49.3% as described above. The reason why such a ratio da/DA was selected is to produce an appropriate resistance against the flow of material during the extruding operation of the pins 13 for piercing spring seat blind-holes.

Figure 6:
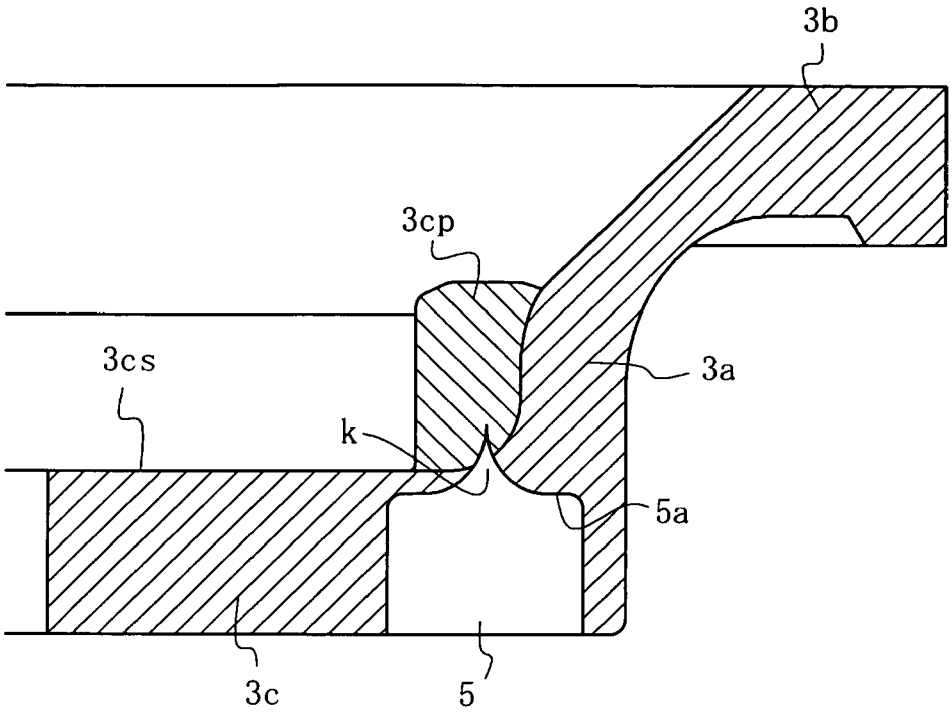
FIG. 6 is a partial sectional illustration of the secondary workpiece showing both tension due to flow of the material into recess holes of an upper die and "cavity" generated at a bottom end of the spring seat blind-holes.
Figure 7:
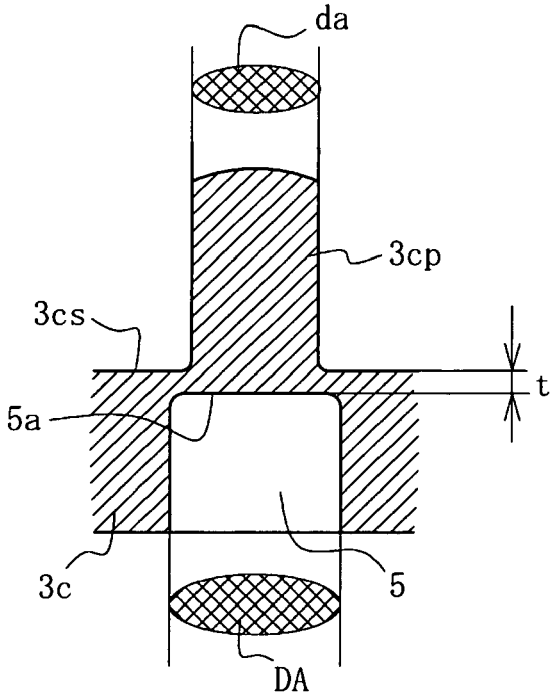
FIG. 7 is a cross sectional illustration showing the relationship between a sectional area of a recess hole and that of a spring seat blind-hole in order to compose an appropriate upper die.

FIG. 6 is an illustration showing an appearance of a cavity at a bottom end of the spring seat blind-hole 5 in a case in which the spring seat blind-holes were formed at a larger ratio than the required ratio of the sectional area da of the recess hole 10*f*1 bored in the upper die 10*f* to the sectional area DA of the spring seat blind-holes 5 pierced by the extrusion operation with the pin 13 for piercing the spring seat blind-hole. In this case, a cavity is generated on the bottom end of the spring seat blind-hole 5 and a generally tapered vacancy k extends upward to a central upper portion gradually decreasing in diameter. As shown in FIG. 7, in the present example, the thickness of the bottom end of the spring seat blind-hole 5, namely the distance between the bottom surface 5*a* of the spring seat blind-hole 5 and a front surface 3*cs* of the end plate 3*c* of the secondary workpiece 3 was confined to 1 mm. Consequently, if a cavity is generated at the bottom end of the spring seat blind-hole 5, as shown in FIG. 6, an inconvenient situation in which a hole may appear at the bottom end of the spring seat blind-hole 5 would occur when a projection 3*cp* projecting in front of the end plate 3*c* is formed.

Therefore, the ratio da/DA of the sectional area da of the recess holes 10*f*1 having been formed in the upper die 10*f* to the sectional area DA of the spring seat blind-hole 5 should be confined so as to generate an appropriate resistance against the flow of material so that the resistance may be in such a degree as to prevent generation of any cavities at the bottom end of the spring seat blind-holes 5 pierced by the extrusion operation with the pins 13 for piercing the spring seat blind-hole. The aim is to prevent generation of the cavity through making an appropriate resistance against the flow occur. The ratio da/DA×100 is not always the same depending on the properties such as malleability, ductility of the material of the blank 1, however, generally around 45-55% is preferable and 48-52% is more preferable.

Further, in the present example, as shown in FIG. 4, a part of the section of the recess hole 10*f*1 is overlapped with a circumferential sidewall 3*a* rising from the end plate 3*c* of the secondary workpiece 3. This overlapping combined with the fact that the ratio da/DA of the sectional area da of the recess hole 10*f*1 to the sectional area DA of the spring seat blind-hole 5 was confined to about 0.493, namely 49.3% as described above, made the more appropriate resistance against the flow of material generated by the extruding operation with the pins 13 for piercing the spring seat blind-hole, resulting in no generation of cavity on a bottom surface 5*a* of the spring seat blind-hole 5 to be formed.

Figure 8A:
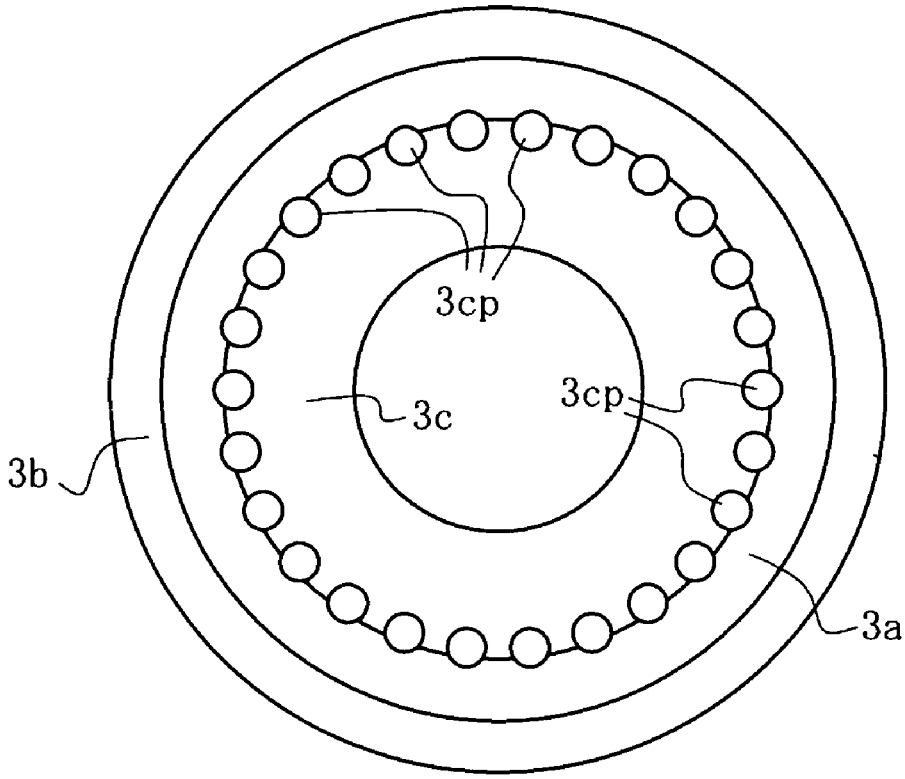
FIG. 8A is a schematic front view of the secondary workpiece showing an appearance of the secondary workpiece in which projections are projected.
Figure 8B:
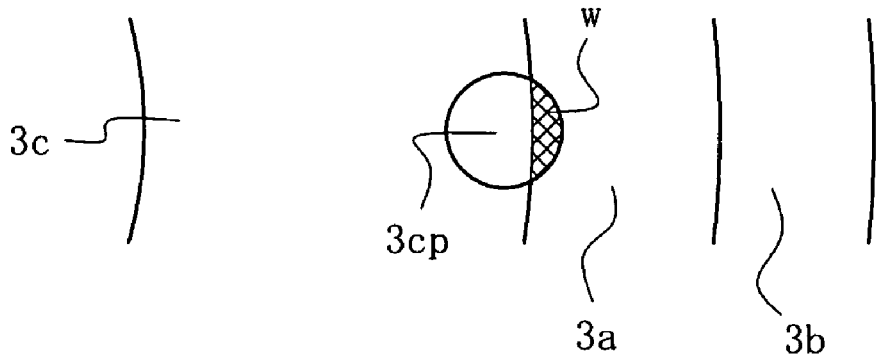
FIG. 8B is a front illustration of a partially enlarged FIG. 8A showing the overlapping ratio of the section of projections with a circumferential sidewall

As described above, since a part of the section of the recess hole 10*f*1 is overlapped with the circumferential sidewall 3*a*, as shown in FIGS. 8A and 8B, a part of a projection 3 cp projecting in front of the end plate 3*c* of the secondary workpiece 3 due to the extruding operation with the pins 13 for piercing the spring seat blind-hole is naturally overlapped with the circumferential sidewall 3*a*. The ratio wa/pa of the sectional area wa of the overlapped portion w to the sectional area pa of the projection 3*cp* (=the sectional area da of the recess hole 10*f*1) will be 0.143 or 14.3%, because in the present example the sectional area pa of the projection 3*cp* is about 34.2 $mm^2$ deduced from its diameter of 6.6 mm and the sectional area wa of the overlapped portion w is 4.9 $mm^2$, so that 4.9/34.2, namely 0.143, also wa/pa×100=14.3%. And at this overlapped situation, the resistance against the flow of material is appropriate during the extrusion operation with the pins 13 for piercing the spring seat blind-hole.

With regard to the preceding problem, many tests other than the above example, such as 6.5 mm or 7.0 mm in diameter of the recess hole 10*f*1, were studied and it has been realized that the resistance against the flow of material during the extrusion operation with the pins 13 for piercing the spring seat blind-hole is appropriate resulting in no generation of any cavities at the bottom surface 5*a* of the spring seat blind-holes 5 to be pierced, when the ratio wa/pa of the sectional area wa of the overlapped portion w to the sectional area pa of the projection 3*cp* (=the sectional area da of the recess hole 10*f*1) was confined to 0.1-0.2 namely wa/pa×100=10-20%.

By the way, if the diameter of the recess hole 10*f*1, namely the diameter of the projection 3*cp* is confined to 6.5 mm, the sectional area pa is nearly 33.18 $mm^2$ and the sectional area wa of the overlapped portion w is 4.59 $mm^2$ resulting in the fact that the ratio wa/pa to the area da of recess hole 10*f*1 (the sectional area pa of the projection 3*cp*) is 0.138 or a percentage of wa/pa×100=13.8%. Besides, if the diameter of the recess hole 10*f*1, namely the diameter of the projection 3*cp* is confined to 7.0 mm, the sectional area pa is nearly 38.48 $mm^2$ and the sectional area wa of the overlapped portion w is 6.22 $mm^2$ resulting in the fact that the ratio wa/pa to the area da of recess hole 10*f*1 (the sectional area pa of the projection 3 cp) is 0.162 or a percentage of wa/pa×100=16.2%.

Both of them are within an appropriate range and the resistance against the flow of material is appropriate during the extrusion operation with the pins 13 for piercing the spring seat blind-hole.

Further, the pins 13 for piercing the spring seat blind-hole were ordinarily disposed free to move up and down, back and forth in the guide holes 11*f*1 of the lower die 11*f*, and a knockout pin 15 was disposed free to move up and down in a through-hole 11*f*2 for making the knockout pin pass through.

Besides, the lower die 11*f* and the upper dies 10*f*, 10*g* were made of SKD61 steel block and radically nitride-treated. And the pins 13 for piercing the spring seat blind-hole were made of cemented carbide.

Using the forging machine mentioned above, the spring seat blind-holes 5 were formed into the region along the backside peripheral edge portion of the end plate 3*c* of the secondary workpiece 3.

As shown in FIG. 4, the secondary workpiece 3 with its backside downward was set on the lower die 11*f*, and the upper dies 10*f*, 10*g* were lowered to butt their lower surfaces on the front surface of the secondary workpiece 3. Then, the oil hydraulic cushion machine was actuated to apply the upward cushion pressure to the lower die 11*f* with the cushion supports 14 and simultaneously applying the downward pressure from the upper dies 10*f*, 10*g*.

At the situation above, the spring seat blind-holes 5 were pierced into the region along the backside surface of the end plate 3*c* of the secondary workpiece 3 by raising the pins 13 for piercing: the spring seat blind-hole to perform the forward extrusion operation. Thereby, the material, extruded to flow from the site where the spring seat blind-holes 5 were pierced, moved forward into the recess holes 10*f*1 bored in the upper die 10*f*, resulting in appropriate formation of the spring seat blind-holes 5. Since the sectional area da of the recess holes 10*f*1 was confined appropriately as described above and a part of the recess holes 10*f*1 was overlapped at an appropriate ratio with the circumferential sidewall 3*a* rising upright from the end plate 3*c* of the secondary workpiece 3, no cavities were generated on the bottom surfaces 5*a* of the spring seat blind-holes 5.

Since the appropriate cushion pressure was applied to the lower die 11*f* and the pressure corresponding to the cushion pressure was also applied to the upper dies 10*f*, 10*g*, there were no problems in that flowing material flowed into any other site except the recess hole 10*f*1 to protrude at an inconvenient site such as the backside of the end plate 3*c* of the secondary workpiece 3 leading to deformation of the essential shape of the site. Therefore the secondary workpiece 3 could maintain its proper shape.

Further, since the extrusion operation as described above with the pins 13 for piercing the spring seat blind-hole is applied to the beforehand flattened region along the backside peripheral edge portion of the end plate 3*c* of the secondary workpiece 3, there is no fear that an unbalanced load may be applied to the pins 13 for piercing the spring seat blind-hole. Consequently, the pins 13 for piercing the spring seat blind-hole will have high endurance to achieve a long life. Further, since the pins 13 for piercing the spring seat blind-hole can keep precisely a linear reciprocal motion, high precision forming of the spring seat blind-holes 5 also can be carried out.

Then, in the present example, the projections 3*cp* projecting in front of the secondary workpiece 3 were turned off (removed) with a lathe as shown in FIG. 3.

Moreover, the secondary workpiece 3 described above, is then worked at the expansion 3*b* by the existing well-known method to form a sliding circumferential sidewall which contacts in a sliding manner with a cylinder, finally finishing a piston body Consequently, according to the present example of the method of forming spring seat blind-holes into a piston for an automobile transmission, the spring seat blind-holes 5 can be formed at a far higher speed than that of drilling and at high precision.

Further, in the present example, a metallic plate of the prescribed composition is forged and spring seat blind-holes are pierced by extrusion. The operations can be carried out at a high speed as described above. However, it is extremely difficult to form accurate spring seat blind-holes without the occurrence of any problems such as cracks, or deformation because there is little excess material around itself. In spite of the difficulty, in the present example as can be understood through the above explanations, the reliable forming of the spring seat blind-holes with high precision has been achieved successfully using every means in technology.

INDUSTRIAL APPLICABILITY

The present invention can be effectively utilized in the field of producing automobile transmission especially in forming a plurality of spring seat blind-holes on the back of an end plate of a piston for an automobile transmission

REFERENCE SIGNS LIST

1 a blank
2 a primary workpiece
2*a* a center-hole
2*b* a circumferential sidewall
3 a secondary workpiece
3*a* a circumferential sidewall
3*b* an expansion
3*c* an end plate
3*c*1 a backside peripheral edge portion of an end plate
3*c*2 a protrusion protruded on the backside of an end plate
3*c*3 a protrusion which flowed and protruded on the front side of an end plate
3*cp* a projection
3*cs* a front surface of an end plate
5 a spring seat blind-hole
5*a* a bottom surface of a spring seat blind-hole
10*a* an upper die of a stamping press for forming a primary workpiece
10*b* a central upper die of a stamping press for secondary workpiece
10*c* a peripheral upper die of a stamping press for secondary workpiece
10*f* a central upper die of a stamping press for forming a spring seat blind-hole
10*f*1 a recess hole
10*g* a peripheral upper die of a stamping press for forming a spring seat blind-hole
11*a* a lower die of a stamping press for forming a primary workpiece
11*b* a central lower die of a stamping press for secondary workpiece
11*c* a peripheral lower die of a stamping press for secondary workpiece
11*f* a central lower die of a stamping press for forming a spring seat blind-hole
11*f*1 a guide hole
11*f*2 a through-hole
12*a* a punch
13 a pin for piercing a spring seat blind-hole
14 a cushion support
15 a knockout pin
α an angle formed by a circumferential side wall and horizontal plane of a primary workpiece
a1 the arrow showing the direction of extruding a pin for piercing a spring seat blind-hole
a2 the arrow showing the direction of flow of material toward an end plate
a3 the arrow showing the direction of flow of material toward a circumferential sidewall
a4 the arrow showing the direction of cushion pressure
da nsectional area of a recess hole
DA sectional area of a spring seat blind-hole
da/DA the ratio of da to DA
k a tapered vacancy
pa sectional area of a projection t thickness of a bottom end of a spring seat blind-hole
w an overlapped portion
wa sectional are of an overlapped portion
wa/pa the ratio of sectional area of an overlapped portion to that of a projection

We claim:

1. A method of forming spring washer blind-holes in a piston for an automobile transmission, comprising:

flattening an annular region of a metallic sheet blank to form a secondary workpiece, the annular region to be located along a peripheral edge portion of an end plate of a piston body, said flattening including:

punching out a center hole in the center of the metallic sheet blank while simultaneously deep-drawing the metallic sheet blank in such a manner as to form a preliminary workpiece having a circumferential sidewall rising at an oblique incline with respect to an original plane of the metallic sheet blank;

forming the preliminary workpiece into a secondary workpiece by forming the circumferential sidewall of the preliminary workpiece to be upright with respect to the original plane of the metallic sheet blank;

increasing a thickness of the peripheral edge portion at a rear of the end plate by flattening part of the end plate located inside the circumferential sidewall; and further thickening the peripheral edge portion at the rear of the end plate and making a rear surface of the peripheral edge portion of the end plate perpendicular to a radially outer surface of the peripheral edge portion of the end plate by drawing an external periphery of the circumferential sidewall;

forming a plurality of spring washer blind-holes along the peripheral edge portion at the rear of the end plate of the secondary workpiece, said forming of the plurality of spring washer blind-holes including performing an extrusion process comprising projecting a plurality of pins into the peripheral edge portion at the rear of the end plate to form the spring washer blind-holes, a quantity and location of the pins corresponding to a desired quantity and location of the spring washer blind-holes; and performing said extrusion process so that all of the material extruded by the extrusion process due to the projecting of the pins flows so as to project out of a front surface of the end plate to form front surface projections.

2. The method of claim 1, wherein said extrusion process comprises simultaneously projecting the pins into the peripheral edge portion so as to simultaneously form the plurality of spring washer blind-holes.

3. The method of claim 1, wherein said extrusion process comprises projecting the pins through guide holes in a lower die for pressing the rear surface of the end plate, while pressing the front surface of the end plate with an upper die having recess holes corresponding to locations of the guide holes in the lower die for guiding the pins, said extrusion process being performed so that material flowing due to projecting of the pins into the peripheral edge portion will be induced to flow into the recess holes located in the upper die.

4. The method of claim 3, further comprising applying upward cushion pressure to the lower die at least during said extrusion process.

5. The method of claim 3, wherein a sectional area of each of the recess holes in the upper die is sized such that no cavity will be generated at a bottom end of each of the spring washer blind-holes formed with the pins.

6. The method of claim 3, wherein a sectional area of each of the recess holes in the upper die is in a range of 45% to 55% of a sectional area of each of the spring washer blind-holes formed with the pins.

7. The method of claim 3, wherein a part of each of the recess holes in the upper die is located to overlap with the circumferential sidewall rising from the end plate, a ratio of the sectional area of the overlapped part of each of the recess holes to an entire sectional area of each of the recess holes is in a range of 10% to 20%.

8. The method of claim 1, further comprising removing the front surface projections formed due to material flowing due to the extrusion process.

9. The method of claim 8, wherein said removing of the front surface projections comprises machining the front surface projections using a lathe.

* * * * *